US008037574B2

(12) United States Patent
Chase

(10) Patent No.: US 8,037,574 B2
(45) **Date of Patent: *Oct. 18, 2011**

(54) FURNITURE-GLIDE ASSEMBLY

(75) Inventor: John Chase, Rochester Hills, MI (US)

(73) Assignee: Hiwatt Products, LLC, Rochester, MI (US)

( * ) Notice: Subject to any disclaimer, the term of this patent is extended or adjusted under 35 U.S.C. 154(b) by 437 days.

This patent is subject to a terminal disclaimer.

(21) Appl. No.: 12/106,555

(22) Filed: Apr. 21, 2008

(65) Prior Publication Data

US 2008/0244870 A1 Oct. 9, 2008

Related U.S. Application Data

(63) Continuation-in-part of application No. 11/784,257, filed on Apr. 6, 2007, now Pat. No. 7,757,346.

(51) Int. Cl.
*A47B 91/06* (2006.01)

(52) U.S. Cl. ..... 16/42 R; 16/42 T; 248/188.9

(58) Field of Classification Search ..... 16/42 R, 16/42 T, 18 CG, 30; 248/188.9, 188.4, 346.11, 248/677, 188.8; 297/16.1–16.2, 463.1–463.2; D8/274

See application file for complete search history.

(56) References Cited

U.S. PATENT DOCUMENTS

| | | | | |
|---|---|---|---|---|
| D33,589 | S | 11/1900 | Higgins | D8/107 |
| 870,770 | A | 11/1907 | Fuller | |
| D44,996 | S | 12/1913 | Buser | D8/374 |
| 1,903,609 | A | 4/1933 | Uhl | 16/42 R |
| 1,915,272 | A | 6/1933 | Duncan, Jr. | 248/188.9 |
| 1,921,561 | A * | 8/1933 | Christmas | 248/188.9 |
| 2,457,723 | A | 12/1948 | Pura | 16/32 |
| D167,876 | S | 9/1952 | Auer | D8/374 |
| 2,637,063 | A | 5/1953 | Becker | 16/42 R |
| 2,641,016 | A | 6/1953 | Kramcsak, Jr. | 16/39 |
| 2,644,978 | A | 7/1953 | Becker | 16/42 |
| 2,687,547 | A | 8/1954 | Matter | 16/30 |

(Continued)

FOREIGN PATENT DOCUMENTS

DE 40 30 557 C1 9/1991

OTHER PUBLICATIONS

Sep. 16, 2005 Office Action in connection with U.S. Appl. No. 10/941,162, filed Sep. 15, 2004.

(Continued)

*Primary Examiner* — Robert Sandy
*Assistant Examiner* — Jeffrey O Brien
(74) *Attorney, Agent, or Firm* — Brooks Kushman P.C.

(57) ABSTRACT

A glide assembly is adapted to be mounted about an existing foot attached to the free end of a leg of a piece of furniture that is adapted to be supported upon a surface. The glide assembly includes a body defining an exterior surface and a bore extending partially through the body to define a hollow interior, an interior surface, a top, open end of the body, and a bottom, closed end of the body disposed opposite the open end. An insert assembly is mountable about the foot and adapted to be received through the open end and fixedly secured within the hollow interior of the body so as to mount the body about the foot. A cap is designed to be replaceably attached to the closed end of the body and adapted to engage the surface upon which the leg is supported.

17 Claims, 6 Drawing Sheets

U.S. PATENT DOCUMENTS

| | | | | |
|---|---|---|---|---|
| D173,835 | S | 1/1955 | Chapman et al. | D8/374 |
| 2,738,541 | A | 3/1956 | Thornsbury | 16/42 R |
| 2,875,552 | A | 3/1959 | Stillman | 248/188.9 |
| 2,902,794 | A | 9/1959 | Ehrgott | 248/188.9 |
| 3,191,213 | A | 6/1965 | Congdon | 16/42 R |
| 3,363,280 | A | 1/1968 | LeVasseur | 16/42 R |
| 3,389,421 | A | 6/1968 | Wheeler | 16/42 R |
| 3,641,620 | A | 2/1972 | Hage | 16/19 |
| 4,731,901 | A | 3/1988 | Daniels | 16/42 R |
| 4,754,714 | A | 7/1988 | Drumm | 108/157.18 |
| 5,081,740 | A | 1/1992 | Smith | 16/42 R |
| 5,191,676 | A | 3/1993 | Gerner | 16/42 |
| D336,205 | S | 6/1993 | Cooper | D7/624.1 |
| 5,220,705 | A | 6/1993 | Bushey | 16/42 R |
| D340,638 | S | 10/1993 | Campbell | D8/374 |
| 5,426,818 | A | 6/1995 | Bushey | 16/42 R |
| D376,753 | S | 12/1996 | Nakamura | D8/374 |
| D383,377 | S | 9/1997 | Sellers | D8/374 |
| 5,873,144 | A * | 2/1999 | Tupper et al. | 16/18 CG |
| 6,324,725 | B1 | 12/2001 | Green | 16/42 T |
| 6,405,982 | B2 | 6/2002 | Ferencz | 248/188.9 |
| 6,471,622 | B1 | 10/2002 | Hammer et al. | 482/54 |
| 6,623,082 | B1 | 9/2003 | Huang | 297/463.1 |
| 6,626,405 | B1 | 9/2003 | Keast et al. | 248/188.9 |
| D487,392 | S | 3/2004 | Chase | D8/374 |
| 6,754,934 | B1 | 6/2004 | Shiffler | 16/42 R |
| 6,883,763 | B2 | 4/2005 | Bosman et al. | 248/188.9 |
| 6,910,246 | B2 * | 6/2005 | Desmarais | 16/42 R |
| D548,577 | S | 8/2007 | Shiffler et al. | |
| 7,404,232 | B2 * | 7/2008 | Chase | 16/42 T |
| 7,757,346 | B2 * | 7/2010 | Chase | 16/42 R |
| 2002/0109054 | A1 * | 8/2002 | Burr | 248/188.4 |
| 2003/0163894 | A1 | 9/2003 | Jones et al. | 16/42 R |
| 2006/0053586 | A1 | 3/2006 | Chase | 16/42 R |
| 2006/0053587 | A1 | 3/2006 | Chase | 16/42 R |
| 2007/0186374 | A1 * | 8/2007 | Thaw et al. | 16/42 R |
| 2008/0191106 | A1 * | 8/2008 | Shiffler et al. | 248/188.9 |

OTHER PUBLICATIONS

Nov. 2, 2005 Final Office Action in connection with U.S. Appl. No. 10/941,162, filed Sep. 15, 2004.

Mar. 14, 2006 Office Action in connection with U.S. Appl. No. 10/941,162, filed Sep. 15, 2004.

May 1, 2006 Final Office Action in connection with U.S. Appl. No. 10/941,162, filed Sep. 15, 2004.

Oct. 10, 2006 Office Action in connection with U.S. Appl. No. 10/941,162, filed Sep. 15, 2004.

* cited by examiner

FURNITURE-GLIDE ASSEMBLY

This is a continuation-in-part application of and claims benefit to U.S. patent application Ser. No. 11/784,257 filed Apr. 6, 2007, now U.S. Pat. No. 7,757,346 issued Jul. 20, 2010, and entitled "Furniture-Glide Assembly."

BACKGROUND OF THE INVENTION

1. Field of the Invention

The present invention relates, in general, to a glide attachable to a leg of a piece of furniture and, in particular, to a glide assembly mountable about an existing foot attached to the free end of a leg of a chair or desk.

2. Description of the Related Art

The free end of each leg of a piece of furniture often includes a cap, foot, glide, or the like. In many institutionalized settings, such as in a school or other educational facility, the feet disposed on the corresponding free ends of the respective legs of a piece of furniture are designed to allow easy sliding of a chair or desk, for instance, upon a surface such as a floor. More specifically, the feet are designed to increase the amount of surface-area contact, but reduce the amount of frictional contact, between the legs and the floor.

One type of foot commonly employed in the related art generally includes an attachment portion and a gliding portion. The attachment portion is adapted to be attached to the free end of a leg, and the gliding portion is pivotally connected to an end of the attachment portion located opposite the leg. The gliding portion defines a relatively broad, flat bottom surface adapted to be in operative contact with the floor. This type of foot is made typically of a hard, durable material, such as metal, nylon, or steel. The bottom surface of a conventional foot is sometimes made of metal or plastic.

However, this type of foot suffers from many disadvantages. The bottom surface of the conventional foot is relatively large, which increases the amount of frictional contact with the floor and causes scraping, scratching, or marring of relatively more surface area of the floor. And, use of this type of foot generally facilitates a sliding motion across the floor and, therefore, increases incidence of floor scraping, scratching, or marring and attendant noise. This relatively greater amount of scraping, scratching, or marring, in turn, increases not only costs of stripping, waxing, and buffing the floor and other labor and material costs associated with maintaining the floor, but also the number of airborne particulates and, thus, pollutants in the room in which the corresponding chair or desk is used. Furthermore, the bottom surface defines relatively more area upon which dirt, dust, sand, and other debris can gather, thus making this type of foot relatively more difficult, time-consuming, and, thus, expensive to clean and keep sanitary. This debris can even be imbedded into the bottom surface of the foot such that the texture of the bottom surface becomes like sandpaper and, thus, scrapes, scratches, or mars the floor even more than it does otherwise.

In addition, when the chair or desk is moved along the floor, the frictional contact between this type of foot and the floor produces a perceptible, often irritating, noise. In a classroom setting, especially in an elementary school where there are a substantial number of relatively young students moving or "scooting" their respective chairs and desks at any one time, this noise can be multiplied to a very significant level. Moreover, the floor upon which the corresponding chair or desk is supported can be mopped weekly, even daily. In such an especially wet environment, this type of foot—being made mostly or even entirely of metal—can rust and, hence, have a relatively shorter life, produce rust marks on the floor when the chair or desk is moved along the floor, and cause the legs of the chair or desk to be aesthetically displeasing.

Because of these disadvantages, it is often desired to replace the existing feet. As it turns out, however, the existing feet, which are initially employed with the respective chairs or desks, are not designed to be removed, so it is often a relatively difficult and, thus, expensive chore to remove all of them. Furthermore, the legs of the corresponding chairs or desks on which the respective conventional feet are used are often disposed at different angles relative to the floor. A replacement foot of the type known in the related art has suffered from the disadvantage that it is not adapted to interface between the free end of the corresponding leg and the floor at an appropriate angle. This has resulted in uneven contact of the foot with the floor and, thus, increased scraping, scratching, or marring of the floor by the foot and generation of more noise by the chair or desk as it is moved relative to the floor. A replacement foot of the type known in the related art has also suffered from the disadvantage that the portion of it that operatively contacts the floor inevitably becomes worn to the point that the replacement foot is no longer adequately effective for its intended purpose. Yet, this portion is not replaceable by itself such that even though the remainder of the replacement foot may have much more useful life, the entire replacement foot must be replaced. Of course, this results in wasted material and, thus, money. A replacement foot of the type known in the related art has also suffered from the disadvantage that it has hinges, locking prongs, and/or seams exposed that would allow dirt, dust, sand, and other debris to collect therein. These difficulties have presented a barrier to use of improved caps, feet, glides, and such.

Thus, there is a need in the related art for a relatively efficient way of replacing an existing foot from a leg of a chair or desk with a glide. More specifically, there is a need in the related art for a relatively easy and, thus, inexpensive way of mounting an aftermarket replacement glide to the free end of a leg of a chair or desk. In particular, there is a need in the related art for a glide that is adapted to accommodate an existing foot at an appropriate angle relative to a floor while reducing incidence of floor scraping, scratching, or marring and generation of noise. In addition, there is a need in the related art for such a glide that does not rust or otherwise mark the floor. Moreover, there is a need in the related art for such a glide the portion of which operatively contacts the floor is replaceable by itself (without replacing the entire glide). There is a need in the related art for such a glide that does not have hinges, locking prongs, and/or seams exposed that would allow dirt, dust, sand, and other debris to collect therein as well.

SUMMARY OF THE INVENTION

The present invention overcomes the disadvantages in the related art in a glide assembly adapted to be mounted about an existing foot attached to the free end of a leg of a piece of furniture that is adapted to be supported upon a surface. The glide assembly includes a body defining an exterior surface and a bore extending partially through the body to define a hollow interior, an interior surface, a top, open end of the body, and a bottom, closed end of the body disposed opposite the open end. An insert assembly is mountable about the foot and adapted to be received through the open end and fixedly secured within the hollow interior of the body so as to mount the body about the foot. A cap is designed to be replaceably attached to the closed end of the body and adapted to engage the surface upon which the leg is supported.

One advantage of the furniture-glide assembly of the present invention is that it provides a relatively efficient way of replacing the existing foot from the free end of the leg of the furniture piece.

Another advantage of the furniture-glide assembly of the present invention is that it provides a relatively easy and, thus, inexpensive way of mounting an aftermarket replacement glide to the free end of the leg of the furniture piece, especially one that includes an existing foot of the type commonly employed in the related art.

Another advantage of the furniture-glide assembly of the present invention is that it is adapted to accommodate the existing foot.

Another advantage of the furniture-glide assembly of the present invention is that use thereof does not require removal of the existing foot and, thereby, any labor, material, and, thus, expense in connection with removing the existing foot.

Another advantage of the furniture-glide assembly of the present invention is that it is substantially spherical, and, thereby, substantially the same amount of surface area of the glide assembly contacts the surface upon which the furniture piece is supported independent of the angle at which the free end of the leg is engaged relative to the surface.

Another advantage of the furniture-glide assembly of the present invention is that the surface area of the "footprint" of the glide assembly on the surface upon which the furniture piece is supported is substantially less than that of the existing foot.

Another advantage of the furniture-glide assembly of the present invention is that it contacts the surface upon which the furniture piece is supported at only a point or relatively small area, which, in turn, reduces the area of the surface that can be scraped, scratched, or marred.

Another advantage of the furniture-glide assembly of the present invention is that it is operatively effectively independent of the angle at which the free end of the leg is engaged relative to the surface upon which the furniture piece is supported.

Another advantage of the furniture-glide assembly of the present invention is that it can be used on a leg of the furniture piece that is engaged with respect to the surface upon which the furniture piece is supported at any angle within a greater range of angles such that the glide assembly can be used on a greater number of furniture-piece legs.

Another advantage of the furniture-glide assembly of the present invention is that the body thereof is designed to distribute load applied thereto substantially evenly throughout the body.

Another advantage of the furniture-glide assembly of the present invention is that it causes the furniture piece to be more stable and, thereby, safer for a user of the furniture piece.

Another advantage of the furniture-glide assembly of the present invention is that it can be used on practically any type of surface upon which the furniture piece is supported without risk of scraping, scratching, or marring the surface.

Another advantage of the furniture-glide assembly of the present invention is that the cap is easily removable and replaceable by itself (without replacing the entire glide assembly) and, thereby, saves material and, thus, money.

Another advantage of the furniture-glide assembly of the present invention is that it does not have hinges, locking prongs, and/or seams exposed that would allow dirt, dust, sand, and other debris to collect therein.

Another advantage of the furniture-glide assembly of the present invention is that flattening, distortion, and/or separation (e.g., sheering or peeling off) of the cap is prevented when the leg slides across the surface upon which the furniture piece is supported with a heavy load weighing down upon the cap.

Another advantage of the furniture-glide assembly of the present invention is that the exterior surface is non-absorbent, water-resistant, and impervious to dirt, dust, sand, and other debris and most floor chemicals.

Another advantage of the furniture-glide assembly of the present invention is that use thereof generally requires that the furniture piece be picked-up when its movement relative to the surface upon which it is supported is desired and, therefore, reduces incidence of surface scraping, scratching, or marring and attendant noise.

Another advantage of the furniture-glide assembly of the present invention is that frictional contact between it and the surface upon which the furniture piece is supported does not produce a perceptible noise when the furniture piece is moved along the surface.

Another advantage of the furniture-glide assembly of the present invention is that it facilitates reduction in costs of stripping, waxing, and buffing the surface upon which the furniture piece is supported and other labor and material costs associated with maintaining the surface.

Another advantage of the furniture-glide assembly of the present invention is that it is easier and faster to clean and keep sanitary.

Another advantage of the furniture-glide assembly of the present invention is that it is durable.

Another advantage of the furniture-glide assembly of the present invention is that it is more "green-friendly" in that it increases quality of air of a room in which it is used by reducing the amount of contact between the furniture piece and the surface upon which it is supported and, thus, number of airborne particulates.

Another advantage of the furniture-glide assembly of the present invention is that it does not rust and, hence, has a longer life, does not produce rust marks on the surface upon which the furniture piece is supported when it is moved along the surface, and keeps the legs of the furniture piece more aesthetically pleasing.

Another advantage of the furniture-glide assembly of the present invention is that it can be employed with existing feet of various size.

Another advantage of the furniture-glide assembly of the present invention is that it can be manufactured easily and inexpensively.

Other objects, features, and advantages of the present invention are readily appreciated as the same becomes better understood while reading the subsequent description taken in conjunction with the accompanying drawing.

BRIEF DESCRIPTION OF EACH FIGURE OF THE DRAWING

Figure 9:
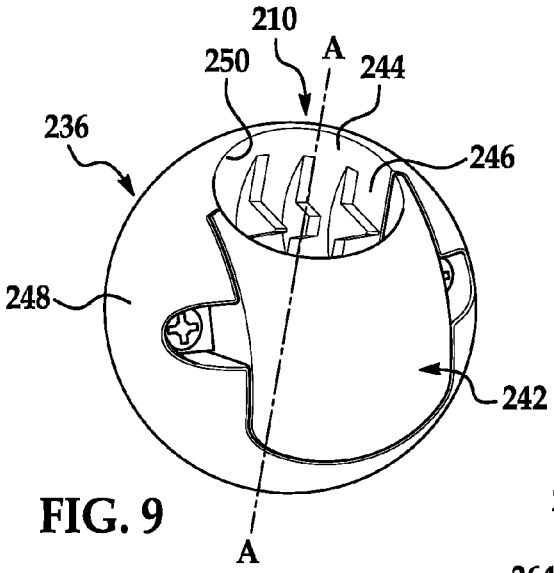
FIG. 9 is a perspective view of another embodiment of the furniture-glide assembly of the present invention.
Figure 10:
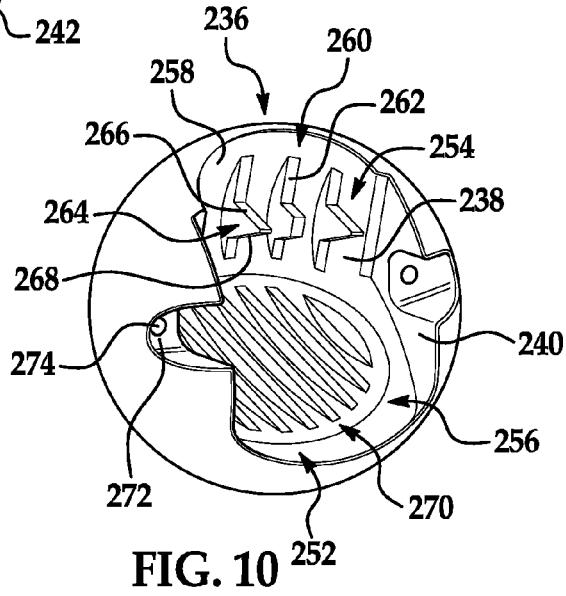
FIG. 10 is a perspective view of a body of the embodiment of the furniture-glide assembly of the present invention illustrated in FIG. 9.
Figure 11:
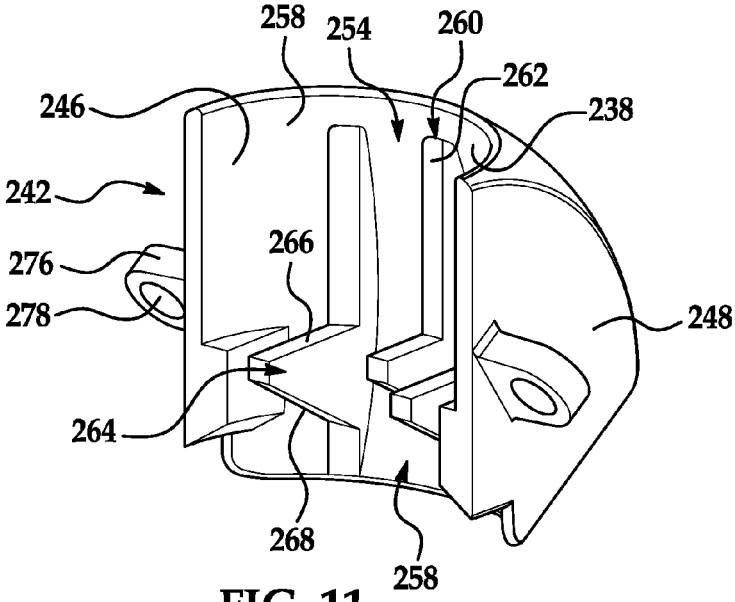
FIG. 11 is a perspective view of a door of the embodiment of the furniture-glide assembly of the present invention illustrated in FIG. 9.
Figure 12:
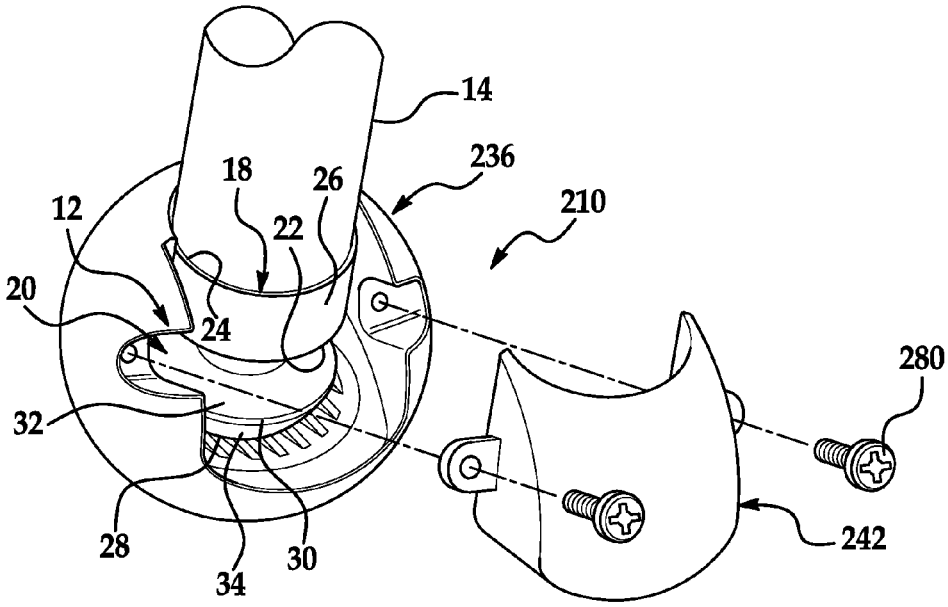
Figure 13:
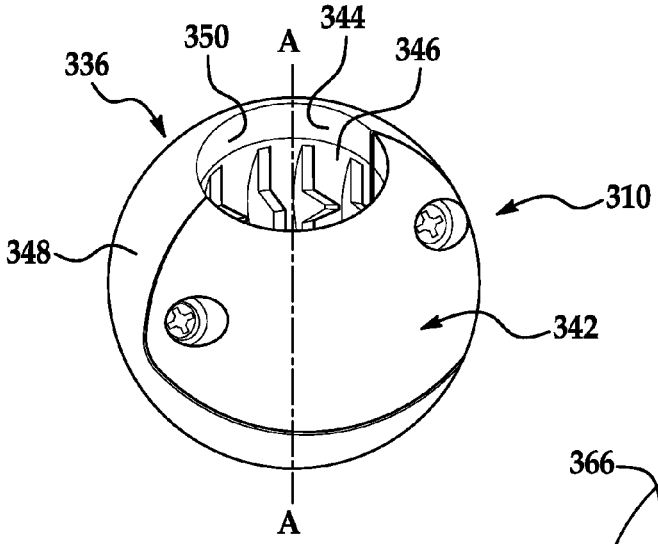
Figure 14:
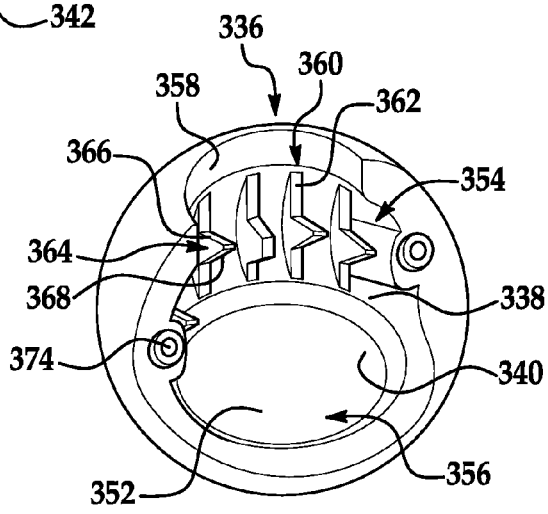
Figure 15:
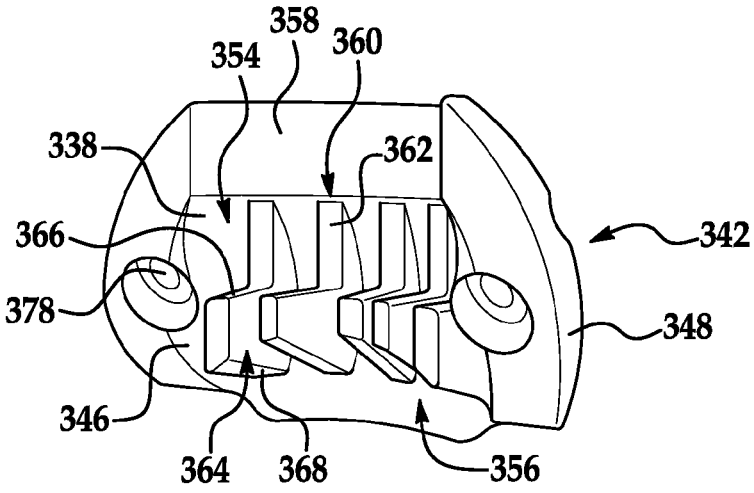
Figure 16:
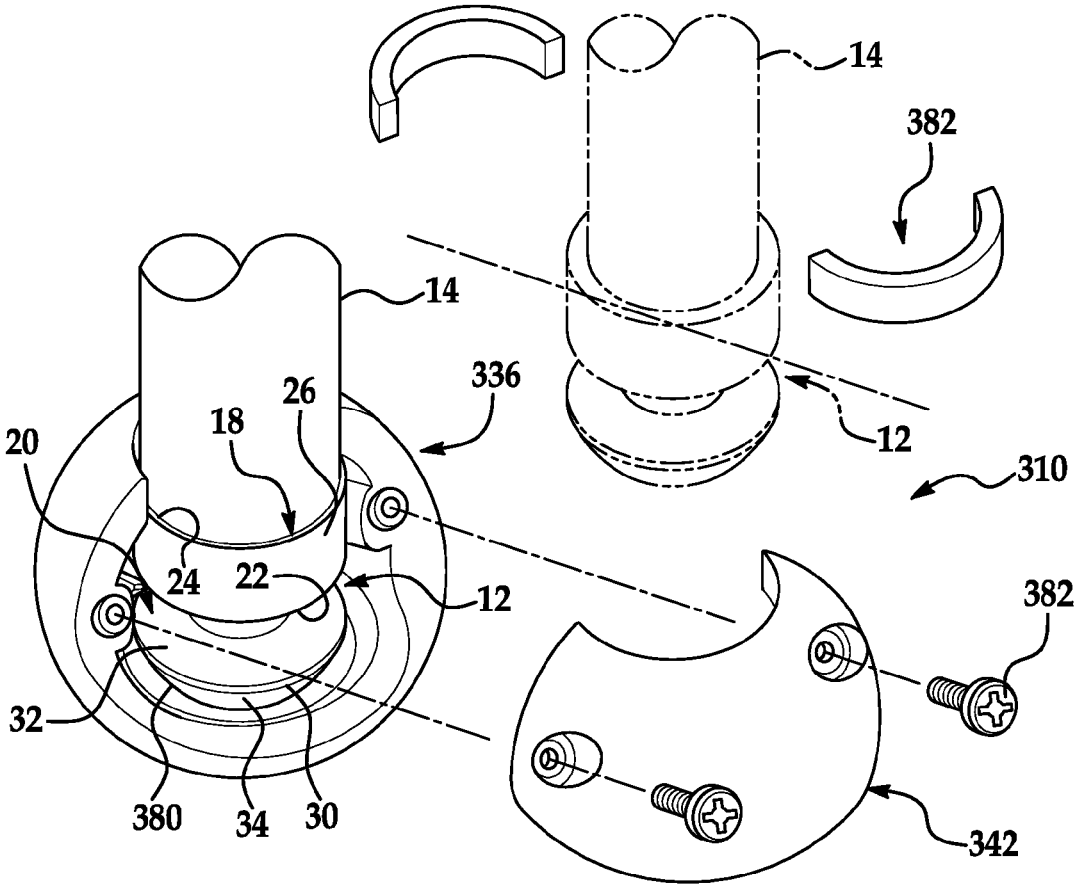

FIG. 12 is a partial-environmental perspective assembly view of the embodiment of the furniture-glide assembly of the present invention illustrated in FIG. 9 showing the door being removably mounted to the body so as to close an opening defined by the body and cooperating with the body to accommodate the foot and define a central bore of the glide assembly accommodating the free end of the leg of the chair or desk;

FIG. 13 is a perspective view of another embodiment of the furniture-glide assembly of the present invention;

FIG. 14 is a perspective view of a body of the embodiment of the furniture-glide assembly of the present invention illustrated in FIG. 13;

FIG. 15 is a perspective view of a door of the embodiment of the furniture-glide assembly of the present invention illustrated in FIG. 13; and FIG. 16 is a partial-environmental perspective assembly view of the embodiment of the furniture-glide assembly of the present invention illustrated in FIG. 13 showing a reducer ring being fitted about a side wall of an upper portion of the foot and the door being removably mounted to the body so as to close an opening defined by the body and cooperating with the body to accommodate the foot and define a central bore of the glide assembly accommodating the free end of the leg.

DETAILED DESCRIPTION OF EMBODIMENTS OF THE INVENTION

Referring now to the figures, where like numerals are used to designate like structure, four embodiments of a furniture-glide assembly of the present invention are generally indicated at 10, 110, 210, 310. The glide assembly 10, 110, 210, 310 is adapted to be mounted about an existing foot, generally indicated at 12 in FIGS. 1, 2, 6, 12, and 16, that is attached to the free end of a leg 14 of a piece of furniture.

The foot 12 is described below and shown in the figures specifically attached about the free end of the leg 14. Also, the glide assembly 10, 110, 210, 310 is described below and shown in the figures used in connection with a chair-desk combination, generally indicated at 16 in FIG. 1. However, it should be appreciated by those having ordinary skill in the related art that the glide assembly 10, 110, 210, 310 can be used in connection with a chair and a desk that are not combined with each other and are, thus, free-standing. It should also be so appreciated that the foot 12 and, thus, glide assembly 10, 110, 210, 310 can be used in connection with any suitable piece of furniture. It should also be so appreciated that the glide assembly 10, 110, 210, 310 can find special application when it is used in connection with chairs and desks of the type commonly employed in institutions, such as schools. However, it should also be so appreciated that the glide assembly 10, 110, 210, 310 is in no way limited to use in this fashion.

Referring now to FIGS. 1, 2, 6, 12, and 16, the foot 12 is substantially cylindrical and includes generally an upper portion, generally indicated at 18, and a lower portion, generally indicated at 20. More specifically, the upper portion is a substantially cylindrical hollow attachment portion 18, and the lower portion is a substantially disk-shaped gliding portion 20. The attachment portion 18 defines a bottom wall or closed end 22, an open end 24, and a side wall 26 extending therebetween of the attachment portion 18. The open end 24 is adapted to receive the free end of the leg 14 such that the free end of the leg 14 is securely attached within the attachment portion 18. Those having ordinary skill in the related art should appreciate that the free end of the leg 14 can be securely attached within the attachment portion 18 by any suitable means.

The gliding portion 20 is typically pivotally connected to and extends from the closed end 22 of the attachment portion 18 away from the leg 14. More specifically, the gliding portion 20 often defines a substantially circular, flat bottom surface 28 located opposite the attachment portion 18 and adapted to pivot with respect to the attachment portion 18 such that the bottom surface 28 can be in operative contact with a floor 29, for example. The gliding portion 20 also includes a side wall and defines a substantial equator 30 that divides the side wall into an upper side exterior surface 32 and a lower side exterior surface 34. The upper side exterior surface 32 is substantially planar and tapers from the equator 30 to a central area of the closed end 22 of the attachment portion 18. The lower side exterior surface 34 is substantially planar and tapers from the equator 30 to the circumference of the bottom surface 28 of the gliding portion 20. The amount of surface area of the upper side exterior surface 32 is greater than that of the lower side exterior surface 34 such that the circumference of the equator 30 is greater than that of the bottom surface 28 of the gliding portion 20. The gliding portion 20 is broader than the attachment portion 18.

It should be appreciated by those having ordinary skill in the related art that the foot 12, in general, and each of the attachment portion 18 and gliding portion 20, in particular, can have any suitable shape, size, and structure. It should also be so appreciated that each of the attachment portion 18 and gliding portion 20 can have any suitable structural relationship with the other, the free end of the leg 14, and the floor 29.

It should also be so appreciated that the attachment portion 18 and gliding portion 20 form no part of the present invention.

Thus, while there are four different embodiments of the glide assembly 10, 110, 210, 310 disclosed herein, those having ordinary skill in the related art should appreciate that, within the scope of the appended claims, other means of providing the mounting of the glide assembly 10, 110, 210, 310 to the foot 12 may be possible without departing from the scope of the present invention. Accordingly, the various embodiments of the present invention illustrated in the figures are described in greater detail below.

Referring now to FIGS. 2 through 5B, the structure of the glide assembly 10 is addressed. The glide assembly 10 is adapted to be mounted about the foot 12, which, in turn, is adapted to be supported upon the floor 29. To this end, the glide assembly 10 includes a body, generally indicated at 36, defining an exterior surface, generally indicated at 48, and a bore 44 extending partially through the body 36 to define a hollow interior 38, an interior surface, generally indicated at 46, and an open end 50 of the body 36. An insert assembly, generally indicated at 37, is mountable about the foot 12 and adapted to be received through the open end 50 and fixedly secured within the hollow interior 38 of the body 36 so as to mount the body 36 about the foot 12.

More specifically, the body 36 is substantially spherical and defines a central axis "A." The exterior surface 48 is adapted to be disposed in contact with the floor 29. The bore 44 is substantially cylindrical and extends through nearly the entire body 36 such that the bore 44 defines a closed end 39 of the body 36. The central longitudinal axis of the bore 44 defines the axis "A" of the body 36. The bore 44 is adapted to be coaxial with the free end of the leg 14.

However, it should be appreciated by those having ordinary skill in the related art that the body 36 can have any suitable size and structure, such as being hollow. It should also be so appreciated that the bore 44 can extend any suitable distance through the body 36 and have any suitable structural relationship with the axis "A" of the body 36. Similarly, the bore 44 can have any suitable shape and size such that the insert assembly 37 can be disposed within the bore 44 and structural relationship with the free end of the leg 14 so as to mount the body 36 about the foot 12.

The exterior surface 48 of the body 36 may be textured. In particular, the exterior surface 48 includes a plurality of slightly raised surfaces 41 adapted to facilitate smooth frictional contact between the glide assembly 10 and the floor 29. In the embodiment shown, the raised surfaces 41 are substantially non-uniformly shaped and non-contacting with respect to each other, substantially smooth, and raised a substantially equal height with respect to each other above the exterior surface 48 of the body 36, which is only a slight amount relative to the radius of the body 36. The exterior surface 48 also defines a substantially uniform circular and planar rim 43 completely encircling the open end 50 of the body 36.

However, it should be appreciated by those having ordinary skill in the related art that the exterior surface 48 of the body 36 can include any suitable number of raised surfaces 41. In turn, the raised surfaces 41 can have any suitable shape, size, and texture and structural relationship with each other and the remainder of the body 36. For instance, the raised surfaces 41 can be substantially uniformly shaped and contacting with respect to each other, substantially rough, and raised a substantially unequal height with respect to each other above the exterior surface 48 of the body 36. Alternatively, the exterior surface 48 of the body 36 can include no raised surfaces 41 and be substantially smooth. It should also be so appreciated that the rim 43 of the exterior surface 48 can have any suitable shape, size, and structure and structural relationship with the remainder of the exterior surface 48. Alternatively, the exterior surface 48 of the body 36 can define no rim 43 and be completely arcuate.

Figure 5A:
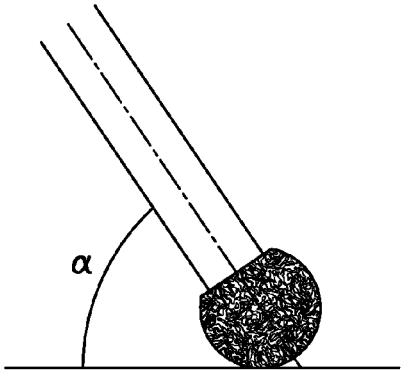
FIG. 5A is a partial-environmental perspective view of the leg of the chair illustrated in FIG. 1 supported upon the floor at a particular angle with respect to the floor showing the furniture-glide assembly of the present invention mounted to the free end of the leg.
Figure 5B:
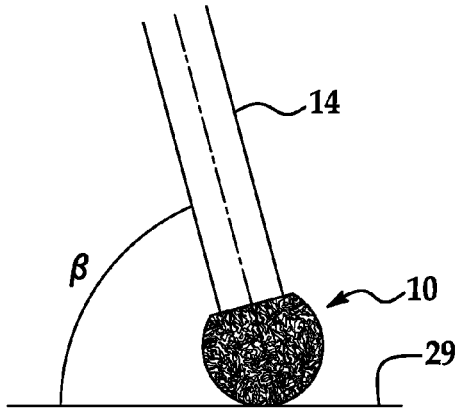
FIG. 5B is a partial-environmental perspective view of the leg of the desk illustrated in FIG. 1 supported upon the floor at a particular angle with respect to the floor different than that at which the chair leg is engaged with respect to the floor in FIG. 5A and showing the furniture-glide assembly of the present invention mounted to the free end of the leg.

The spherical nature of the body 36 creates numerous advantages of the glide assembly 10 over caps, feet, and other glides of the related art. More specifically and as shown in FIGS. 5A and 5B, substantially the same amount of surface area of the glide assembly 10 contacts the floor 29 independent of the angle at which the free end of the leg 14 is engaged relative to the floor 29. In fact, the glide assembly 10 can be used on a leg 14 of the chair or desk 16 that is engaged with respect to the floor 29 at any angle within a greater range of angles such that a sufficient amount of the glide assembly 10 always operatively engages the floor 29. In this way, the glide assembly 10 causes the chair or desk 16 to be more stable and, thereby, safer for a user of the chair or desk 16 and can be used on a greater number of furniture-piece legs 14. For instance, in FIG. 5A, the free end of the leg 14 of the chair 16 is disposed at angle "$\alpha$" with respect to the floor 29, and in FIG. 5B, the free end of the leg 14 of the desk 16 is disposed at angle "$\beta$" with respect to the floor 29, wherein angle "$\beta$" is greater than angle "$\alpha$." Thus, the glide assembly 10 is operatively effectively independent of the angle at which the free end of the leg 14 is engaged relative to the floor 29.

As can be easily seen, because of the spherical nature of the glide assembly 10, the surface area of the "footprint" of the glide assembly 10 on the floor 29 is substantially equal in both cases and substantially less—about 80% less—than that of the furniture foot of the related art. The glide assembly 10 contacts the floor 29 at only a point or relatively small area, which, in turn, reduces the surface area of the floor 29 that can be scraped, scratched, or marred. The glide assembly 10 is more aesthetically pleasing and defines relatively much less surface area thereof upon which dirt, dust, sand, and other debris can gather, thus making the glide assembly 10 easier and faster to clean and keep sanitary. The glide assembly 10 is durable and more "green-friendly" in that it increases quality of air of a room in which it is used by reducing the amount of contact between the chair or desk 16 and the floor 29 and, thus, number of airborne particulates. The glide assembly 10 is designed to distribute load applied thereto substantially evenly throughout the body 36.

Figure 4:
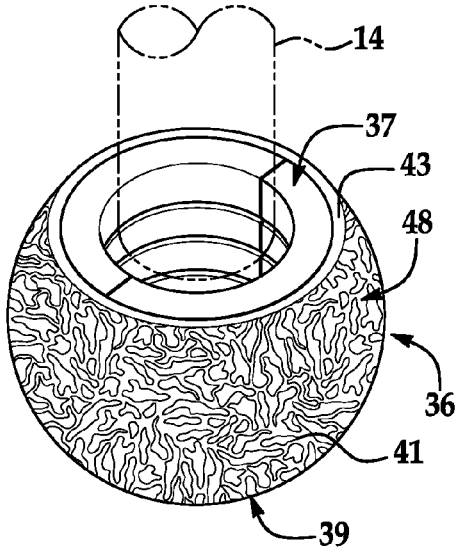
FIG. 4 is a partial-environmental perspective view of the embodiment of the furniture-glide assembly of the present invention illustrated in FIG. 2 showing the body mounted about the insert assembly and, in turn, the glide assembly mounted about the foot of the chair or desk and, thus, the free end of the corresponding leg.

The insert assembly 37 includes a pair of insert parts, generally indicated at 45, adapted to be fitted about the foot 12 and securely attached to each other about the foot 12 to mount the insert assembly 37 thereabout, all of which is described in detail below. The insert assembly 37 is substantially cylindrical and defines an exterior surface, generally indicated at 47, and a passageway 49 extending at least partially through the insert assembly 37 to define a hollow interior 51 and at least one open end 53 of the insert assembly 37. In an embodiment of the glide assembly 10, the insert assembly 37 defines a pair of opposed, substantially identical open ends 53 of the insert assembly 37 such that the closed end 39 of the body 36 operatively supports a bottom surface of the foot 12. The foot 12 is adapted to at least partially, even completely, fit within the hollow interior 51 of the insert assembly 37 to mount the insert assembly 37 about the foot 12. As shown in FIG. 4, a rim 55 of the insert assembly 37 is disposed substantially flush with the rim 43 of the body 36.

However, it should be appreciated by those having ordinary skill in the related art that the insert assembly 37 can have any suitable shape, size, and structure so as to be receivable through the open end 50 and within the bore 44 of the body 36. For instance, the top of the insert assembly 37 can be disposed any suitable distance above or below the rim 43 of the body 20. It should also be so appreciated that the passageway 49 can have any suitable structural relationship with the insert assembly 37. The passageway 49 can have any suitable shape and size and structural relationship with the foot 12 such that the foot 12 is adapted to fit within the hollow interior 51 of the insert assembly 37 to mount the insert assembly 37 about the foot 12. It should also be so appreciated that any suitable amount of the foot 12 can fit within the hollow interior 51 of the insert assembly 37 to mount the insert assembly 37 about the foot 12.

Figure 1:
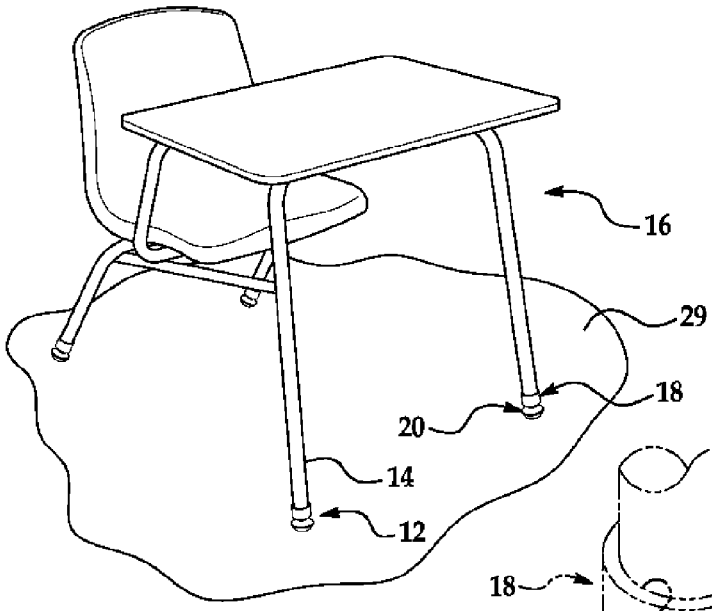
FIG. 1 Prior Art
FIG. 1 is an environmental perspective view of a representative example of a chair-desk combination supported upon a floor showing a typical furniture foot of the related art fixedly secured about the free end of each of two legs of a chair and two legs of a desk.
Figure 2:
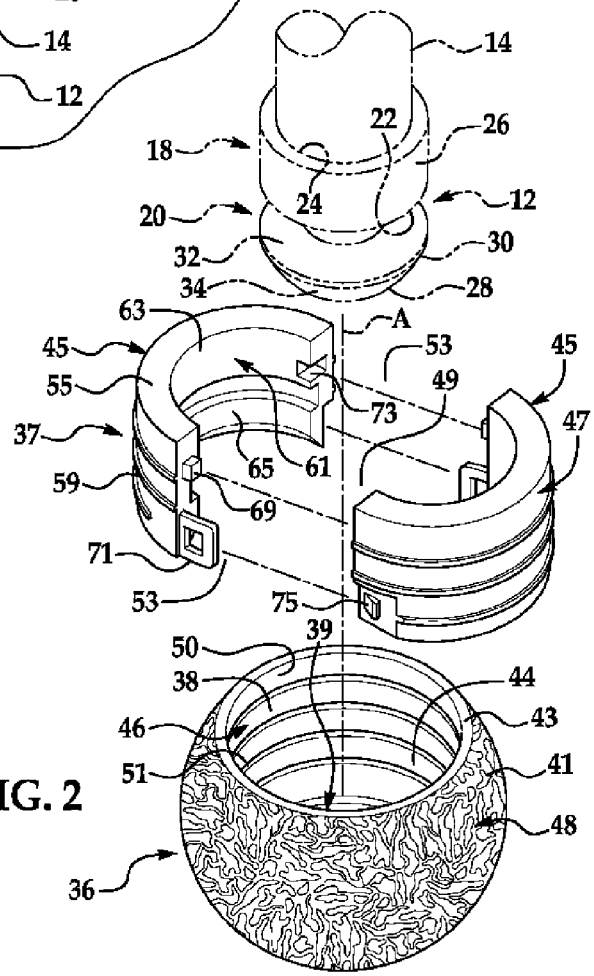
FIG. 2 is a partial-environmental exploded perspective view of one embodiment of the furniture-glide assembly of the present invention.
Figure 3:
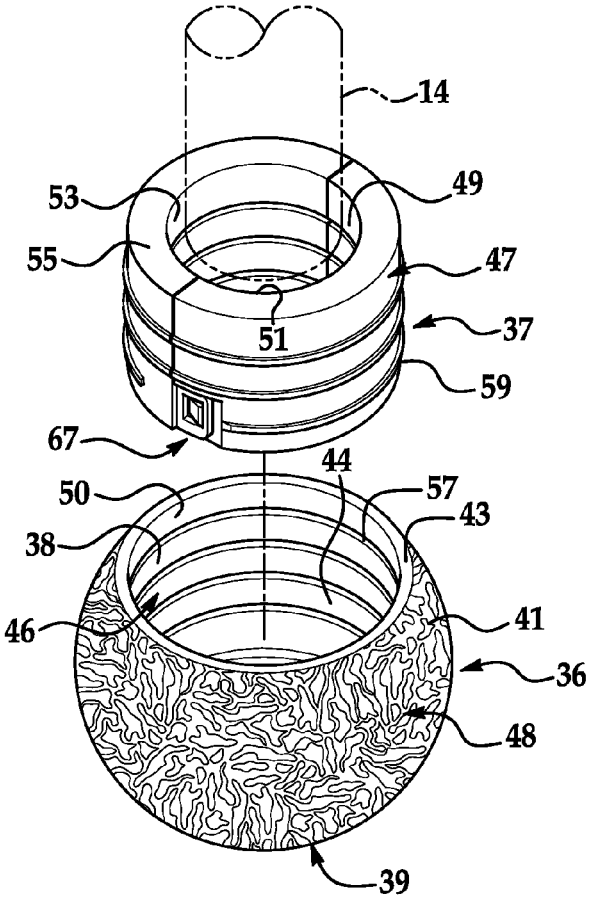
FIG. 3 is a partial-environmental perspective assembly view of the embodiment of the furniture-glide assembly of the present invention illustrated in FIG. 2 showing the insert assembly mounted about a foot of the chair or desk and, thus, the free end of the corresponding leg.

As shown in FIGS. 2 and 3, the interior surface 46 of the body 36 includes at least one groove 57, and the exterior surface 47 of the insert assembly 37 includes at least one rib 59 adapted to cooperate with the groove 57 to fixedly secure the body 36 about the insert assembly 37. In the embodiment shown, the interior surface 46 of the body 36 includes a plurality of grooves 57, and the exterior surface 47 of the insert assembly 37 includes a plurality of ribs 59 adapted to cooperate with the corresponding grooves 57 to fixedly secure the body 36 about the insert assembly 37. As shown, the grooves 57 are substantially equidistantly spaced and disposed substantially parallel with respect to each other and perpendicular to the free end of the leg 14. Also, each groove 57 is disposed substantially entirely about the bore 44 of the body 36, and the corresponding rib 59 is disposed substantially entirely about the exterior surface 47 of the insert assembly 37.

However, it should be appreciated by those having ordinary skill in the related art that the interior surface 46 of the body 36 can include any suitable number of grooves 57 and the exterior surface 47 of the insert assembly 37 can include any suitable number of ribs 59 adapted to cooperate with the groove(s) 57 to fixedly secure the body 36 about the insert assembly 37. It should also be so appreciated that each groove 57 can have any suitable shape and size and structural relationship with each of any of the other grooves 57, the corresponding rib 59, and the bore 44 of the body 36. In turn, it should also be so appreciated that each rib 59 can have any suitable shape, size, and structure and structural relationship with each of any of the other ribs 59 so as to cooperate with the groove(s) 57 to fixedly secure the body 36 about the insert assembly 37.

As shown in FIGS. 2 through 4, the hollow interior 51 of the insert assembly 37 defines an interior surface, generally indicated at 61, of the insert assembly 37. The interior surface 61 of each insert part 45 is adapted to be nested with a corresponding portion of the foot 12. In particular and referring specifically to FIG. 2, the interior surface 61 defines an upper portion 63 and a lower portion 65 of the interior surface 61. The shape of the upper portion 63 is adapted to conform to the shape of the outside surface of the attachment portion 18 of the foot 12, and the shape of the lower portion 65 is adapted to conform to the shape of the outside surface of the gliding portion 20 of the foot 12. The upper portion 63 is designed to support the side wall 26 of the attachment portion 18, and the lower portion 65 is designed to taper away from the free end of the leg 14 to support the lower side exterior surface 34 of the gliding portion 20. In this way, the interior surface 61 of an insert part 45 can be firmly nested with a corresponding portion of the foot 12, the interior surface 61 of the other insert part 45 can be firmly nested with the remainder of the foot 12, and the closed end 39 of the body 36 can operatively support the bottom surface 28 of the foot 12.

As shown in FIGS. 2 and 3, the insert parts 45 are adapted to be snappingly engaged to each other to mount the insert assembly 37 about the foot 12. In particular and referring specifically to FIG. 3, each end of one insert part 45 combines with a corresponding end of the other insert part 45 to form a snapping mechanism, generally indicated at 67. As shown in FIG. 2, each snapping mechanism 67 includes a stud 69 located on a side edge of an insert part 45 and a hollow flange 71 located spaced from and substantially directly beneath the stud 69 and extending circumferentially outward from the side edge. An aperture 73 is defined into the opposed side edge of the other insert part 45 and adapted to receive the stud 69 when the insert parts 45 are brought into contacting relationship with each other. A boss 75 is located spaced from and beneath the aperture 73 on the exterior surface 47 of the insert part 45 and adapted to be received within the hollow flange 71 when the insert parts 45 are brought into contacting relationship with each other. When the insert parts 45 are brought into contacting relationship with each other, they snappingly engage to each other to mount the insert assembly 37 about the foot 12.

However, it should be appreciated by those having ordinary skill in the related art that each insert part 45, in general, and interior surface 61 thereof, in particular, can have any suitable shape, size, and structure and structural relationship with a corresponding portion of the foot 12 so as to nestingly fit the insert assembly 37 about the foot 12. It should also be so appreciated that the insert parts 45 can be securely attached to each other in any suitable manner to mount the insert assembly 37 about the foot 12.

Preferably, the insert assembly 37 is made of plastic, in general, and either high-density polyethylene (HDPE) or nylon, in particular. The insert assembly 37 is preferably made of DuPont® Zytel® lubricated or unlubricated nylon resin. On the other hand, the body 36 is preferably made of a soft PVC material such that frictional contact between the glide assembly 10 and the floor 29 does not produce a perceptible noise and rust marks on the floor 29 when the chair or desk 16 is moved along the floor 29. In any event, the glide assembly 10 is preferably a device having a dual durometer with typically the insert assembly 37 made of a hard plastic material and the body 36 made of a softer plastic material.

However, it should be appreciated by those having ordinary skill in the related art that the insert assembly 37 can be made of any suitable material and the body 36 can be made of any suitable soft material such that it does not scrape, scratch, or mar the floor 29. In the same manner, the exterior surface 48 of the glide assembly 10 can have any suitable texture such that frictional contact between the glide assembly 10 and the floor 29 does not produce a perceptible noise and rust marks on the floor 29 when the chair or desk 16 is moved along the floor 29. Likewise, the exterior surface 48 of the glide assembly 10 can be any suitable color and have any suitable color combination so as to have a desired aesthetic appeal.

The soft nature of the body 36 creates numerous advantages of the glide assembly 10 over caps, feet, and other glides of the related art. More specifically, the glide assembly 10 can be used on practically any type of floor, including, but not limited to, carpeted, marble, Terrazo, tile, VCT, and wood floors. The exterior surface 48 is non-absorbent, water-resistant, and impervious to dirt, dust, sand, and other debris and most floor chemicals. Frictional contact between the glide assembly 10 and the floor 29 does not produce a perceptible noise when the chair or desk 16 is moved along the floor 29. Use of the glide assembly 10 generally requires that the chair or desk 16 be picked-up when its movement relative to the floor 29 is desired and, therefore, reduces incidence of scraping, scratching, or marring of the floor 29 and attendant noise. In this way, the glide assembly 10 facilitates reduction in costs of stripping, waxing, and buffing the floor 29 and other labor and material costs associated with maintaining the floor 29.

The glide assembly 10 does not rust and, hence, has a longer life, does not produce rust marks on the floor 29 when the chair or desk 16 is moved along the floor 29, and keeps the free end of the legs 14 of the chair or desk 16 more aesthetically pleasing.

In operation, the interior surface 61 of a first insert part 45 is firmly nested with a corresponding portion of the foot 12 to be replaced, and then the interior surface 61 of a second insert part 45 is firmly nested with the remainder of the foot 12 and snappingly engaged to the first insert part 45 so as to mount the insert assembly 37 about the foot 12. The free end of the leg 14 and, thus, the foot 12 and insert assembly 37 are then raised off the floor 29 a sufficient amount to allow the insert assembly 37 to be received through the open end 50 of the body 36. The insert assembly 37 is then received through the open end 50 and within the hollow interior 38 of the body 36 until the closed end 39 of the body 36 operatively supports the bottom surface 28 of the foot 12 such that the body 36 is fixedly secured about the insert assembly 37 and, thus, foot 12. The free end of the leg 14 and, thus, the foot 12 and glide assembly 10 are then lowered to the floor 29 such that the glide assembly 10 can be used for frictional contact with the floor 29.

Figure 6:
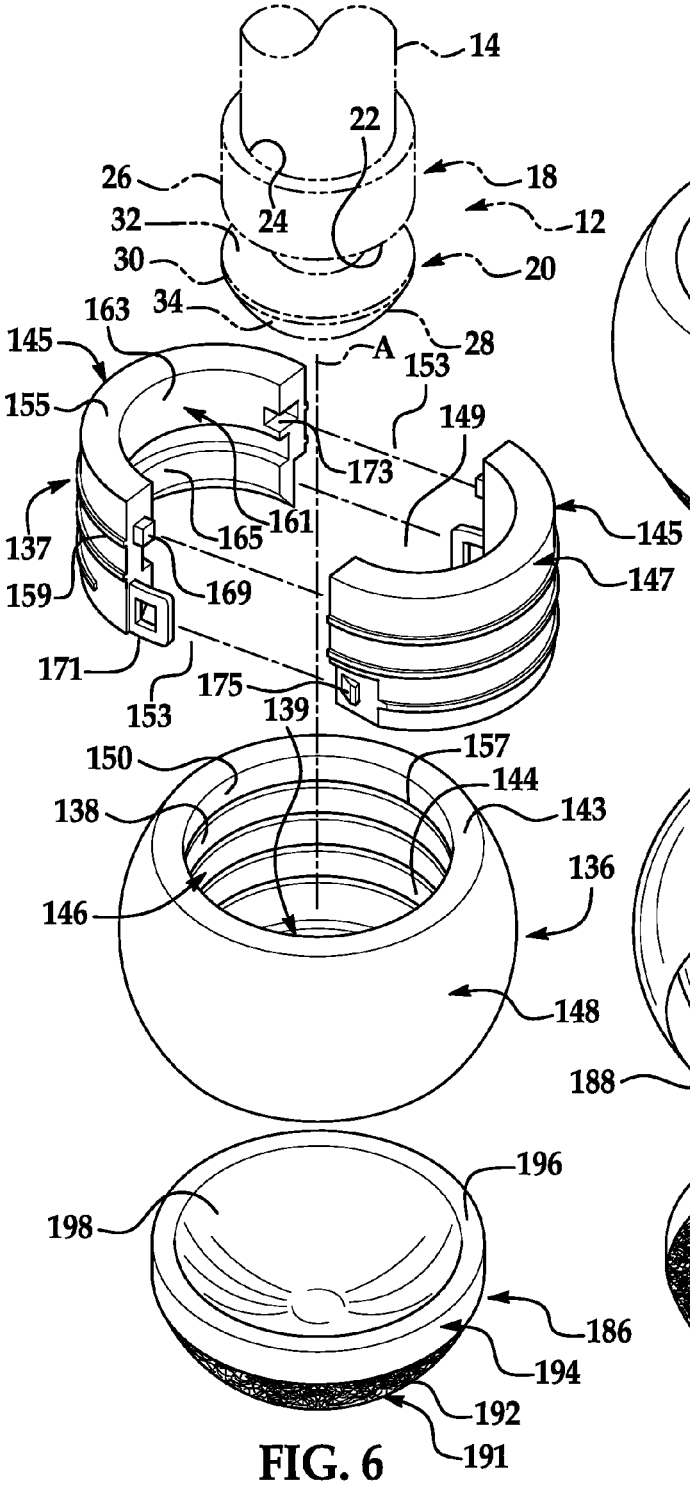
FIG. 6 is a partial-environmental exploded perspective view of another embodiment of the furniture-glide assembly of the present invention.
Figure 7:
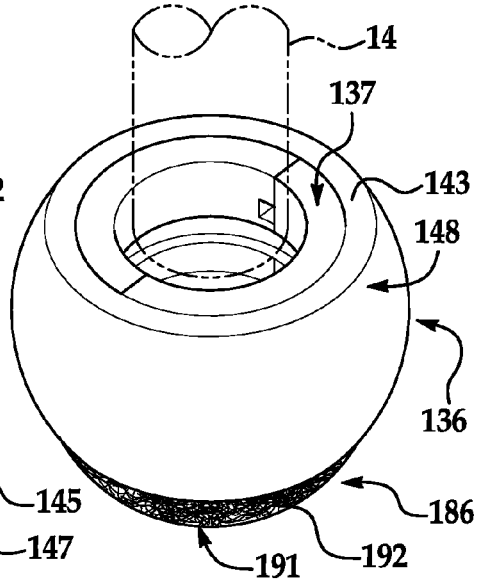
FIG. 7 is a partial-environmental perspective view of the embodiment of the furniture-glide assembly of the present invention illustrated in FIG. 6 showing the body mounted about the insert assembly and, in turn, the glide assembly mounted about the foot of the chair or desk and, thus, the free end of the corresponding leg.
Figure 8:
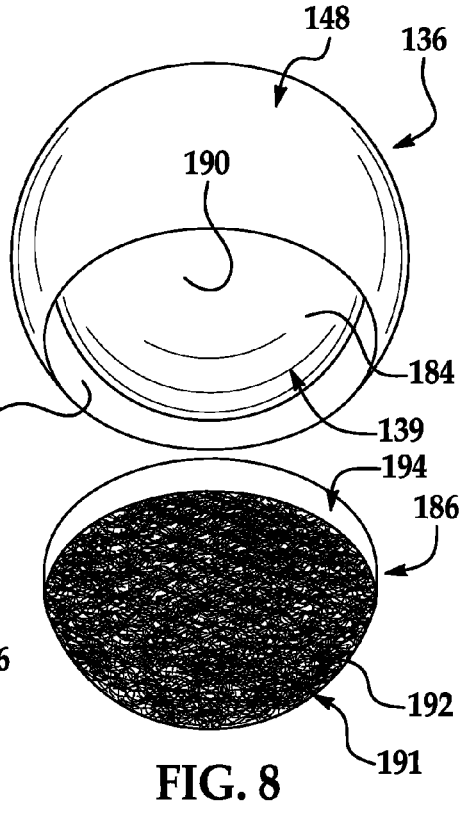
FIG. 8 is a perspective assembly view of the annular rim of the body designed to replaceably receive the cap of the embodiment of the furniture-glide assembly of the present invention illustrated in FIG. 6.

Referring now to FIGS. 6 through 8, another embodiment of the glide assembly is generally indicated at 110. Similar or like parts of the glide assembly 110 with respect to the glide assembly 10 have similar or like reference numerals as those of the glide assembly 10 increased by one hundred (100). However, since structure relating to supporting the glide assembly 110 upon the floor 29 vis-à-vis the structure relating to supporting the glide assembly 10 upon the floor 29 is the only difference between the glide assembly 110 and the glide assembly 10, respectively, only this difference is described immediately below.

As shown in FIGS. 6 and 8, the body 136 of the glide assembly 110 defines the bottom, closed end, generally indicated at 139, of the body 136 disposed opposite the top, open end 150 of the body 136. A cap, generally indicated at 186, is designed to be replaceably attached to the closed end 139 and adapted to engage the floor 29.

More specifically, the closed end 139 of the body 136 defines a convex (as viewed in FIG. 8), cross-sectionally circular surface 184 and an annular rim 188 that protrudes about the circumference of the convex surface 184 and downward. The convex surface 184 and rim 188 combine with each other to provide a recessed volume 190 for replaceably and nestingly receiving the cap 186.

In turn, the cap 186 defines a convex (as viewed in FIG. 8), cross-sectionally circular bottom surface, generally indicated at 191, and an annular side wall, generally indicated at 194, that protrudes upward from the circumference of the bottom surface 191 and defines a top edge 196. In the embodiment shown, a felt pad 192 is disposed upon the entire bottom surface 191 and adapted to engage the floor 29. The cap 186 defines also a concave (as viewed in FIG. 6), cross-sectionally circular surface 198 located interior of and extending from the top edge 196. The space defined directly and immediately above the concave surface 198 provides a recessed volume for replaceably and nestingly receiving the convex surface 184 of the closed end 139.

The cap 186 can be frictionally fitted into the recessed volume 190 such that the concave surface 198 nestingly abuts the convex surface 184 and the side wall 194 frictionally abuts the rim 188. Alternatively or additionally, the cap 186 can be bonded with a suitable adhesive (not shown) to the convex surface 184 and/or rim 188 such that the cap 186 is fitted into the recessed volume 190. For example, glue or tape or any other suitable adhesive can be disposed on the side wall 194 and/or concave surface 198 for bonding the side wall 194 and/or concave surface 198 to the rim 188 and/or convex surface, respectively.

The rim 188 operatively surrounds at least a portion of the side wall 194 of the cap 186 and helps to prevent flattening, distortion, and/or separation (e.g., sheering or peeling off) of the cap 186 when the leg 14 slides across the floor 29 with a heavy load weighing down upon the cap 186. The cap 186 extends downward a distance below the rim 188 so that the felt pad 192 rests on the floor 29 without the rim 188 contacting the floor 29. As shown in FIG. 7, when the cap 186 is properly received within the recessed volume 190, the body 136 of the glide assembly 110 takes on its substantially spherical nature.

Preferably, the cap 186 is made of plastic, and the rim 188 is made of rubber. Also preferably, the cap 186 and felt pad 192 are substantially water-resistant and impervious to floor chemicals.

In operation, the felt pad 192 may wear down over time so that the cap 186, and even the rim 188, may eventually engage the floor 29. The cap 186 and rim 188 are formed of a material that does not scrape, scratch, or mar floor 29. However, in the event that the felt pad 192 or cap 186 wears down to this level so that the cap 186 or rim 188, respectively, hits the floor 29, the cap 186 and, thus, felt pad 192 can be easily removed and replaced with a new cap 186 and, thus, felt pad 192 that protrude down considerably below the rim 188, thus avoiding continued contact of the cap 186 or rim 188 on the floor 29.

It should be appreciated by those having ordinary skill in the related art that each of the closed end 139 of the body 136—including each of the convex surface 184, annular rim 188, and recessed volume 190—and cap 186—including each of the bottom surface 191, felt pad 192, side wall 194, and concave surface 198—can have any suitable shape, size, and structure and structural relationship with each other such that the cap 186 is replaceably attachable to the closed end 139 and adapted to engage the floor 29. It should be so appreciated also that the cap 186 can be fitted into the recessed volume 190 and/or bonded to the closed end 139 in any suitable manner. It should be so appreciated also that the felt pad 192 can have any suitable shape, size, and structure and structural relationship with each of the cap 186 and floor 29 and be disposed upon the cap 186 in any suitable manner. It should be so appreciated also that the cap 186 can extend downward any suitable distance below the rim 188 so that the felt pad 192 rests on the floor 29. It should be so appreciated also that each of the closed end 139 of the body 136 and cap 186 can be made of any suitable material.

The curved nature of the surface of the cap 186 that contacts the floor 29 means less surface area of the glide assembly 110 that contacts the floor 29 relative to glide assemblies of the related art. Also, unlike glide assemblies of the related art, the spherical glide assembly 110 does not have any hinges, locking prongs, or seams exposed that would allow dirt, dust, sand, and other debris to collect therein.

Referring now to FIGS. 9 through 12, another embodiment of the glide assembly is generally indicated at 210. Similar or like parts of the glide assembly 210 with respect to the glide assembly 10 have similar or like reference numerals as those of the glide assembly 10 increased by one hundred (200).

The glide assembly 210 is adapted to be mounted about the foot 12. To this end, the glide assembly 210 includes a body, generally indicated at 236, defining a hollow interior 238 and an opening 240 in a portion of the body 236. A door, generally indicated at 242, is removably mountable to the body 236 so as to substantially close the opening 240. The door 242 also cooperates with the body 236 to define an interior 238 of the glide assembly 210 adapted to accommodate the foot 12 and a central bore 244 of the glide assembly 210 adapted to accommodate the free end of the leg 14.

As shown, the glide assembly 210 is substantially spherical and defines an axis "A" extending through the substantial midpoint of the glide assembly 210. The interior 238 is substantially concentric with respect to and symmetrical about the axis "A" and defines an interior surface 246 of the glide assembly 210. Also, the opening 240 is defined as about one quadrant of the body 236. Furthermore, the glide assembly 210 defines a substantially spherical exterior surface 248. In addition, the bore 244 is substantially cylindrical and coaxial with respect to the axis "A" and cooperates with the exterior surface 248 to define a substantially circular bore opening 250 through which the free end of the leg 14 is adapted to be accommodated. Moreover, the bore 244 extends only partially through the glide assembly 210 to define a bore closing, generally indicated at 252, located in the body 236 opposite the bore opening 250 and adapted to operatively support the bottom surface 28 of the foot 12. In particular, the bore closing 252 defines a substantially hemispherical divot defining a substantially circular transverse cross-section, which, at its greatest circumference, is substantially congruently aligned with the bore opening 250.

It should be appreciated by those having ordinary skill in the related art that each of the interior 238 and opening 240 can be defined to have any suitable shape and size and relationship with the remainder of the body 236. It should also be so appreciated that the bore 244 and, thus, each of the bore opening 250 and bore closing 252 can be defined to have any suitable shape and size and relationship with the other(s) and the remainder of the glide assembly 210.

Still referring to FIGS. 9 through 12, the interior 238 of the glide assembly 210 includes a top section, generally indicated at 254, adapted to receive substantially the attachment portion 18 of the foot 12 and a bottom section, generally indicated at 256, adapted to receive substantially the gliding portion 20 of the foot 12. More specifically, the interior 238 of each of the body 236 and door 242 includes the top section 254 and bottom section 256. Each top section 254 is adapted to receive at least a part of the attachment portion 18, and each bottom section 256 is adapted to receive at least a part of the gliding portion 20. Preferably, the top section 254 of the body 236 is adapted to receive a substantially longitudinal half of the attachment portion 18 from the closed end 22 to the open end 24 of the attachment portion 18, and the bottom section 256 of the body 236 is adapted to nestingly receive substantially all of the gliding portion 20. Upon mounting of the door 242 to the body 236 so as to close the opening 240, the top section 254 of the door 242 is adapted to receive substantially the remainder of the attachment portion 18, and the bottom section 256 of the door 242 is adapted to receive substantially the remainder of the gliding portion 20.

The top section 254 of the glide assembly 210 is adapted to operatively support the side wall 26 of the attachment portion 18 of the foot 12. To this end, the bore 244 cooperates with the interior surface 246 of the top section 254 to define a circumferential bearing surface 258 disposed about the bore 244 and proximate the bore opening 250. The circumferential bearing surface 258 is adapted to operatively bear against the side wall 26 to operatively support the side wall 26.

At least one rib, generally indicated at 260, integrally extends from each top section 254 in the direction of the bore 244. Preferably, a plurality of substantially identical, equidistantly spaced ribs 260 integrally extend from each top section 254 in the direction of the bore 244. In the assembled state of the glide assembly 210, the ribs 260 of the top section 254 of the body 236 are located substantially opposite and substantially mirror corresponding ribs 260 of the top section 254 of the door 242. As shown, the top section 254 of each of the body 236 and door 242 includes three ribs 260.

More specifically, each set of ribs 260 extends from about the circumferential bearing surface 258 to the interior surface 246 of the bottom section 256 such that space is defined between the ribs 260 and the bore closing 252 of the body 236 and the bottom edge of the door 242, respectively. Each of the ribs 260 defines a bearing surface 262 extending substantially axially such that it cooperates with the circumferential bearing surface 258 to form a substantially linear surface. This linear surface extends substantially parallel with the axis "A" and is adapted to operatively bear against a corresponding area of the side wall 26 of the attachment portion 18 of the foot 12.

The top section 254 of the glide assembly 210 is adapted to operatively support the closed end 22 of the attachment portion 18. To this end, each rib 260 also includes a shoulder, generally indicated at 264, extending inwardly toward the interior 238 of the glide assembly 210 from below the bearing surface 262. More specifically, the shoulder 264 defines a supporting surface 266 extending substantially perpendicular with respect to a corresponding bearing surface 262 and adapted to operatively support a corresponding area of the closed end 22 of the attachment portion 18. Each shoulder 264 also defines a bearing surface 268 extending diagonally downward from a front area of the shoulder 264 to the interior surface 246 of the bottom section 256. The front area of the shoulder essentially separates the top section 254 from the bottom section 256 of the interior 238 of the glide assembly 210. The bearing surface 268 is adapted to operatively bear against a corresponding area of the upper side exterior surface 32 of the gliding portion 20 of the foot 12 to, thereby, operatively support the upper side exterior surface 32.

The shoulder 264 of each of the outside ribs 260 extends substantially the same distance, and these shoulders 264 extend farther than the shoulder 264 of the inside rib 260. In the case of the body 236, the shoulders 264 of the respective outside ribs 260 extend to about the opening 240. In the assembled state of the glide assembly 210, the set of ribs 260 of the body 236 and the set of ribs 260 of the door 242 define a substantially diamond-shaped volume of space disposed between them and adapted to receive the volume of the foot 12 consisting of and disposed proximate an area of connection of the attachment portion 18 and gliding portion 20.

It should be appreciated by those having ordinary skill in the related art that the top section 254 of each of the body 236 and door 242 can include any suitable number of ribs 260. It should also be so appreciated that the ribs 260 can have any suitable shape, size, and structure and structural relationship with each other, the top section 254, and the attachment portion 18 of the foot 12.

A plurality of substantially identical, equidistantly spaced ribs, generally indicated at 270, integrally extend from the bore closing 252 of the body 236. The ribs 270 extend substantially parallel with respect to the shoulders 264 of the upper section 254 and upwardly from the bore closing 252. Together, the ribs 270 define an interrupted, substantially planar surface that is substantially perpendicular to the axis "A" and adapted to operatively support the bottom surface 28 of the gliding portion 20. Each of the ribs 270 extends such that the ends of the respective ribs 270, as a group, substantially outline the bottom surface 28 of the gliding portion 20. The portion of the interior surface 246 defined between the ribs 270 and bearing surfaces 268 of the respective shoulders 264 is shaped to conform to the shape of the lower side exterior surface 34 of the gliding portion 20.

It should be appreciated by those having ordinary skill in the related art that the bore closing 252 can include any suitable number of ribs 270. It should also be so appreciated that the ribs 270 can have any suitable shape, size, and structure and structural relationship with each other, the bore closing 252, and the gliding portion 20 of the foot 12. As shown in FIG. 14, which is described below, it should also be so appreciated that the bore closing 252 can include no ribs.

The body 236 defines at least one hole 274 of the body 236, and the door 242 defines at least one hole 278 of the door 242 operatively aligned with the hole 274 of the body 236 such that the aligned holes 274, 278 can receive a fastener 280 to removably fasten the door 242 to the body 236. More specifically and as shown, the interior surface 246 and exterior surface 248 of the body 236 define a depression 272 extending therebetween exterior each outside rib 260. Each depression 272 defines a hole 274 in a substantially central area of the depression 272. The hole 274 extends only partially through the depression 272 so as to be singularly open-ended.

A tab 276 extends outward from the exterior surface 248 of the door 242 exterior each outside rib 260. Each tab 276 defines a hole 278 extending completely through a substantially central area of the tab 276. The tab 276 is adapted to be received within a corresponding depression 272 of the body 236 such that the hole 274 of the depression 272 is operatively aligned with the hole 278 of the tab 276. In this way, the aligned holes 274, 278 can receive the fastener, such as a screw 280, to removably fasten the door 242 to the body 236.

It should be appreciated by those having ordinary skill in the related art that each of the depressions 272 and tabs 276 can have any suitable shape, size, and structure and structural relationship with the remainder of the body 236 and door 242, respectively. It should also be so appreciated that each hole 274, 278 can have any suitable shape and size and relationship with the corresponding depression 272 or tab 276 to receive the screw 280. It should also be so appreciated that the fastener 280 can be any suitable fastener.

Referring now to FIG. 12, to replace the foot 12 attached to the free end of the leg 14 of the chair or desk 16, the leg 14 is situated such that the foot 12 can be cooperatively received within the body 236 of the glide assembly 210. The door 242 of the glide assembly 210 is cooperatively disposed about the remainder of the foot 12 such that the holes 274, 278 of the body 236 and door 242, respectively, are aligned. A screw 276 is disposed in each set of corresponding holes 274, 278 to securely fasten the body 236 and door 242 to each other and attach the glide assembly 210 to the free end of the leg 14. The process can then be repeated for each of the remaining legs 14 of the chair and desk 16.

It should be appreciated by those having ordinary skill in the related art that the glide assembly 210, in general, and each of the body 236 and door 242, in particular, can have any suitable shape, size, and structure. It should also be so appreciated that the glide assembly 210 can have any suitable structural relationship with the free end of the leg 14 and floor 29. It should also be so appreciated that the body 236 and door 242 can have any suitable structural relationship with each other. It should also be so appreciated that the glide assembly 210 can be designed to cooperatively receive a foot 12 of any suitable shape, size, and structure. It should also be so appreciated that the body 236 and door 242 can be fastened to each other and the glide assembly 210 can be attached to the free end of the leg 14 in any suitable manner.

The interior 238 of the glide assembly 210 is made of a relatively hard material, and the exterior surface 248 of the glide assembly 210 is made of a relatively soft material. Preferably, the interior 238 is made of plastic, and the exterior surface 248 is made of rubber. However, those having ordinary skill in the related art should appreciate that the glide assembly 210 can be made of any suitable material and the exterior surface 248 can have any suitable texture such that frictional contact between the glide assembly 210 and the floor 29 does not produce a perceptible noise and rust marks on the floor 29 when the chair or desk 16 is moved along the floor 29.

Referring now to FIGS. 13 through 16, another embodiment of the glide assembly is generally indicated at 310. Similar or like parts of the glide assembly 310 with respect to the glide assembly 210 have similar or like reference numerals as those of the glide assembly 210 increased by one hundred (100). However, since structure relating to mounting the glide assembly 310 about the foot 12 and removably fastening the door 342 to the body 336 vis-à-vis the structure relating to mounting the glide assembly 210 about the foot 12 and removably fastening the door 242 to the body 236 are the only differences between the glide assembly 310 and the glide assembly 210, respectively, only these difference are described immediately below.

As shown in FIGS. 13 and 16, the top section 354 of the glide assembly 310 is adapted to operatively support the side wall 26 of the attachment portion 18 of the foot 12. To this end, the glide assembly 310 includes a reducer ring, generally indicated at 382, adapted to fit about the side wall 26 and operatively bear against the side wall 26 and top section 354 to, thereby, operatively support the side wall 26. The reducer ring 382 is split to be adapted to fit about side walls 26 of various size.

It should be appreciated by those having ordinary skill in the related art that the reducer ring 382 can have any suitable shape, size, and structure and structural relationship with each of the top section 354 and foot 12. It should also be so appreciated that the glide assembly 310 can include any suitable number of reducer rings 382 of various size adapted to fit about the foot 12 and connect the foot 12 to the glide assembly 310 to, thereby, operatively support the foot 12.

As shown in FIG. 14, the volume located exterior each outside rib 360 and between the interior surface 346 and exterior surface 348 of the body 336 defines a hole 374. The hole 374 extends only partially through the volume so as to be singularly open-ended. Also, as shown in FIG. 15, the volume located exterior each outside rib 360 and between the interior surface 346 and exterior surface 348 of the door 342 defines a hole 378. The hole 378 extends completely through the volume to and through an opposed area of the exterior surface 348 of the door 342 so as to be doubly open-ended. The holes 374 of the body 336 are operatively aligned with the holes 378 of the door 342. In this way, the aligned holes 374, 378 can receive a fastener, such as a screw 380, to removably fasten the door 342 to the body 336. The design of the glide assembly 310, in general, and holes 374, 378, in particular, permits the glide assembly 310 to be manufactured more easily and, thus, less expensively relative the glide assembly 210 as a result of simpler machining operations. For example, the glide assembly 310 does not include any depressions that are at least similar to the depressions 272 of the glide assembly 210.

It should be appreciated by those having ordinary skill in the related art that each hole 374, 378 can have any suitable shape and size and relationship with the remainder of the body 336 or door 342, respectively, to receive the screw 380. It should also be so appreciated that the fastener 380 can be any suitable fastener.

As can easily be seen, the glide assembly 10, 110, 210, 310 provides a relatively efficient way of replacing the existing foot 12 from the free end of the leg 14 of the chair or desk 16 and a relatively easy and, thus, inexpensive way of mounting an aftermarket replacement glide to the free end of the leg 14 of the chair or desk 16, especially one that includes the existing foot 12 (which is of the type commonly employed in the related art). Also, the glide assembly 10, 110, 210, 310 is adapted to accommodate the existing foot 12. And, use of the glide assembly 10, 110, 210, 310 does not require removal of the existing foot 12 and, thereby, any labor, material, and, thus, expense in connection with removing the existing foot 12. Furthermore, the glide assembly 10, 110, 210, 310 is substantially spherical, and, thereby, substantially the same amount of surface area of the glide assembly 10, 110, 210, 310 contacts the floor 29 independent of the angle at which the free end of the leg 14 is engaged relative to the floor 29. In addition, the surface area of the "footprint" of the glide assembly 10, 110, 210, 310 on the floor 29 is substantially less than that of the existing foot 12. Moreover, the glide assembly 10, 110, 210, 310 contacts the floor 29 at only a point or relatively small area, which, in turn, reduces the surface area of the floor 29 that can be scraped, scratched, or marred. Plus, the glide assembly 10, 110, 210, 310 is operatively effectively independent of the angle at which the free end of the leg 14 is engaged relative to the floor 29. Also, the glide assembly 10, 110, 210, 310 can be used on a leg 14 of the chair or desk 16 that is engaged with respect to the floor 29 at any angle within a greater range of angles such that the glide assembly 10, 110, 210, 310 can be used on a greater number of such legs 14. And, the body 36, 136, 236, 336 is designed to distribute load applied thereto substantially evenly throughout the body 36, 136, 236, 336. Furthermore, the glide assembly 10, 110, 210, 310 causes the chair or desk 16 to be more stable and, thereby, safer for a user of the chair or desk 16. In addition, the glide assembly 10, 110, 210, 310 can be used on practically any type of floor 29 without risk of scraping, scratching, or marring the floor 29. Moreover, the cap 186 is easily removable and replaceable by itself (without replacing the entire glide assembly 10, 110, 210, 310) and, thereby, saves material and, thus, money. Plus, the glide assembly 10, 110, 210, 310 does not have hinges, locking prongs, and/or seams exposed that would allow dirt, dust, sand, and other debris to collect therein The exterior surface 48, 148, 248, 348 is non-absorbent, water-resistant, and impervious to dirt, dust, sand, and other debris and most floor chemicals as well. Also, use of the glide assembly 10, 110, 210, 310 generally requires that the chair or desk 16 be picked-up when its movement relative to the floor 29 is desired and, therefore, reduces incidence of scraping, scratching, or marring of the floor 29 and attendant noise. And, frictional contact between the glide assembly 10, 110, 210, 310 and the floor 29 does not produce a perceptible noise when the chair or desk 16 is moved along the floor 29. Furthermore, the glide assembly 10, 110, 210, 310 facilitates reduction in costs of stripping, waxing, and buffing the floor 29 and other labor and material costs associated with maintaining the floor 29. In addition, the glide assembly 10, 110, 210, 310 is easier and faster to clean and keep sanitary, durable, and more "green-friendly" in that it increases quality of air of a room in which it is used by reducing the amount of contact between the chair or desk 16 and the floor 29 and, thus, number of airborne particulates. Moreover, the glide assembly 10, 110, 210, 310 does not rust and, hence, has a longer life, does not produce rust marks on the floor 29 when it is moved along the floor 29, and keeps the legs 14 of the chair or desk 16 more aesthetically pleasing. Plus, the glide assembly 10, 110, 210, 310 can be employed with existing feet 12 of various size and manufactured easily and inexpensively.

The present invention has been described in an illustrative manner. It is to be understood that the terminology that has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. A glide assembly assembled to an existing foot that is attached to a free end of a leg of a piece of furniture, the glide assembly comprising:

an insert assembly including at least two insert parts securely attached to each other about the existing foot, a body defining a bore extending from an open end and partially through the body to define an interior surface that engages the insert assembly, and a lower surface that is at least partially convex and disposed below the existing foot, and a cap having an upper surface that is at least partially concave, wherein the cap is assembled to the body with the upper surface of the cap abutting the lower surface of the body.

2. The glide assembly of claim 1, wherein the insert assembly defines an exterior surface and a passageway extending at least partially through the insert assembly to define a hollow interior, an interior surface, and at least one open end of the insert assembly, the existing foot adapted to fit within the hollow interior of the insert assembly to mount the insert assembly about the existing foot.

3. The glide assembly of claim 2, wherein the insert assembly defines a pair of opposed open ends of the insert assembly such that a closed end of the body operatively supports a bottom surface of the existing foot.

4. The glide assembly of claim 2, wherein the interior surface of the body includes at least one groove and the exterior surface of the insert assembly includes at least one rib adapted to cooperate with the at least one groove to fixedly secure the body about the insert assembly.

5. The glide assembly of claim 2, wherein the interior surface of each of the pair of insert parts is adapted to be nested with a corresponding portion of the existing foot.

6. The glide assembly of claim 2, wherein the pair of insert parts are adapted to be snappingly engaged to each other to mount the insert assembly about the existing foot.

7. The glide assembly of claim 6, wherein each end of one of the pair of insert parts combines with a corresponding end of the other of the pair of insert parts to form a snapping mechanism such that when the pair of insert parts are brought into contacting relationship with each other, the pair of insert parts snappingly engage to each other to mount the insert assembly about the existing foot.

8. The glide assembly of claim 7, wherein the snapping mechanism includes:

a first protrusion located on a side edge of one of the pair of insert parts, a hollow flange located spaced from the first protrusion and extending circumferentially outward from the side edge, an aperture defined into an opposed side edge of the other of the pair of insert parts and adapted to receive the first protrusion when the pair of insert parts are brought into contacting relationship with each other, and a second protrusion located spaced from the aperture on the exterior surface of the other of the pair of insert parts and adapted to be received within the hollow flange when the pair of insert parts are brought into contacting relationship with each other.

9. The glide assembly of claim 1, wherein the body is substantially spherical such that substantially the same amount of surface area of said glide assembly contacts the floor independent of the angle at which the free end of the leg is engaged relative to the floor.

10. The glide assembly of claim 1, wherein said cap is bonded with a suitable adhesive to the convex lower surface of the body.

11. The glide assembly of claim 1, wherein the body further includes a rim extending about a perimeter of the convex surface, and the cap further includes a side wall extending about a perimeter of the concave surface, such that the rim frictionally engages the side wall when the cap is assembled to the body.

12. The glide assembly of claim 11, wherein said rim surrounds at least a portion of the cap.

13. The glide assembly of claim 12, wherein the cap extends downward a substantial distance below the rim so that the cap rests on the underlying surface without the rim contacting the floor.

14. The glide assembly of claim 11, wherein the cap is made of plastic.

15. The glide assembly of claim 11, wherein the rim is made of rubber.

16. The glide assembly of claim 11, wherein the cap is removable from the body.

17. The glide assembly of claim 7, wherein each one of the pair of insert parts includes:

a pair of protrusions extending from the insert part, and a pair of apertures spaced from the pair of protrusions to receive the pair of protrusions from the other of the pair of insert parts in a snapping engagement.

* * * * *